United States Patent [19]

Maier

[11] Patent Number: 4,886,433

[45] Date of Patent: Dec. 12, 1989

[54] DISPLACEMENT MACHINE HAVING SPIRAL CHAMBER AND DISPLACEMENT MEMBER OF INCREASING RADIAL WIDTHS

[75] Inventor: Hans P. Maier, Zurich, Switzerland

[73] Assignee: Agintec AG, Zurich, Switzerland

[21] Appl. No.: 206,721

[22] Filed: Jun. 15, 1988

[30] Foreign Application Priority Data

Jun. 15, 1987 [DE] Fed. Rep. of Germany ..... 3719950

[51] Int. Cl.[4] ..... F01C 1/04

[52] U.S. Cl. ..... 418/55; 418/58; 418/178

[58] Field of Search ..... 418/55 A, 55 B, 178, 418/58

[56] References Cited

U.S. PATENT DOCUMENTS

| | | | |
|---|---|---|---|
| 2,324,168 | 7/1943 | Montelius | 418/55 A |
| 3,884,599 | 5/1975 | Young et al. | 418/55 A |
| 4,300,875 | 11/1981 | Fischer et al. | 418/55 A |
| 4,382,754 | 5/1983 | Shaffer et al. | 418/55 A |
| 4,558,997 | 12/1985 | Sakata et al. | 418/55 A |
| 4,627,800 | 12/1986 | Matsudaira et al. | 418/55 A |
| 4,690,625 | 9/1987 | Murayama et al. | 418/55 A |

FOREIGN PATENT DOCUMENTS

| | | | |
|---|---|---|---|
| 2603462 | 8/1976 | Fed. Rep. of Germany . | |
| 2230773 | 12/1976 | Fed. Rep. of Germany . | |
| 2639174 | 6/1977 | Fed. Rep. of Germany . | |
| 220296 | 1/1925 | United Kingdom | 418/55 B |
| 1367986 | 9/1974 | United Kingdom . | |

*Primary Examiner*—John J. Vrablik

*Attorney, Agent, or Firm*—Foley & Lardner, Schwartz, Jeffery, Schwaab, Mack, Blumenthal & Evans

[57] ABSTRACT

A displacement machine for fluids, having a displacement chamber, arranged in the manner of a groove in a fixed casing, running approximately spirally from an inlet to an outlet and spanning more than 360°, into which chamber a likewise essentially spiral displacement body engages, which is held eccentrically drivably in such a way so as to execute a circular movement limited by the peripheral walls of the displacement chamber, the radii of curvature of the displacement body and the said peripheral walls being dimensioned such that, during its circulating, twist-free movement, the displacement body at least virtually touches the inner and outer peripheral walls at a continuously progressing sealing line.

10 Claims, 8 Drawing Sheets

DISPLACEMENT MACHINE HAVING SPIRAL CHAMBER AND DISPLACEMENT MEMBER OF INCREASING RADIAL WIDTHS

BACKGROUND OF THE INVENTION

The invention relates to a displacement machine for fluids, having a displacement chamber, arranged in the manner of a groove in a fixed casing, running approximately spirally from an inlet to an outlet and spanning more than 360°, into which chamber a likewise essentially spiral displacement body engages, which is held eccentrically drivably in such a way that each of its points executes a circular movement limited by the peripheral walls of the displacement chamber, the radii of curvature of the displacement body and the said peripheral walls being dimensioned such that, during its circulating, twist-free movement, the displacement body at least virtually touches the inner and outer peripheral walls at in each case a continuously progressing sealing line.

Such an embodiment can be taken for example from German Offenlegungsschrift No. 26 03 462. The constructions disclosed here require a particularly high expenditure on production in the pressure region, in other words where displacement chamber and displacement body have very small radii of curvature.

Comparable embodiments are to be taken for example from German Offenlegungsschrift No. 26 39 174, British Published Application No. 1 367 986, U.S. Pat. No. 4,558,997 and U.S. Pat. No. 4,627,800. All these embodiments share the disadvantage of a low overall efficiency.

SUMMARY OF THE INVENTION

It is an object of the present invention to provide a displacement machine for fluids which is of reduced overall size without sacrificing output capacity.

It is another object of the present invention to provide a machine of improved construction and stability.

It is a further object of the present invention to provide a machine which may be driven by the fluid and then operate as a motor or a volumeter, however, it can be motor driven and function as a pump or a compressor.

In accomplishing the foregoing objects, there is provided in accordance with this invention, a displacement machine for fluids comprising a casing member having a displacement chamber therein, the chamber being a groove having inner and outer peripheral walls and extending from an inlet to an outlet, the groove being a spiral exceeding 360°. A displacement device is provided with inner and outer peripheral walls corresponding to the chamber walls, the displacement device being eccentrically mounted in the chamber for circulating, twist-free movement therein in such a manner that the corresponding walls touch in a continuously progressing sealing line, the machine further comprising the following:

(a) the displacement device having a looping angle of less than about 400°;

(b) the chamber and the displacement device, respectively having correspondingly increasing radial widths from a first to a second end thereof;

(c) the displacement device being eccentrically mounted adjacent the second end thereof;

(d) the outlet being positioned adjacent the second end; and (e) the displacement device provided to be driven in a direction corresponding to the increase in the radial width.

In furtherance of accomplishing the objects of the invention, the outer peripheral wall of the displacement chamber includes a plurality of smoothly adjoining part circles of reduced radius, and the inner peripheral wall of the displacement chamber includes at least one part circle. The at least one part circle of the inner peripheral wall of the displacement chamber is at least approximately concentric to one of the part circles of the outer peripheral wall of the displacement chamber. Also, mutually corresponding part circles of the inner and outer walls extend over the same degrees of angle.

Other objects and advantages will become apparent from the following detailed description of the invention when considered in conjunction with the accompanying drawings.

Figure 2:
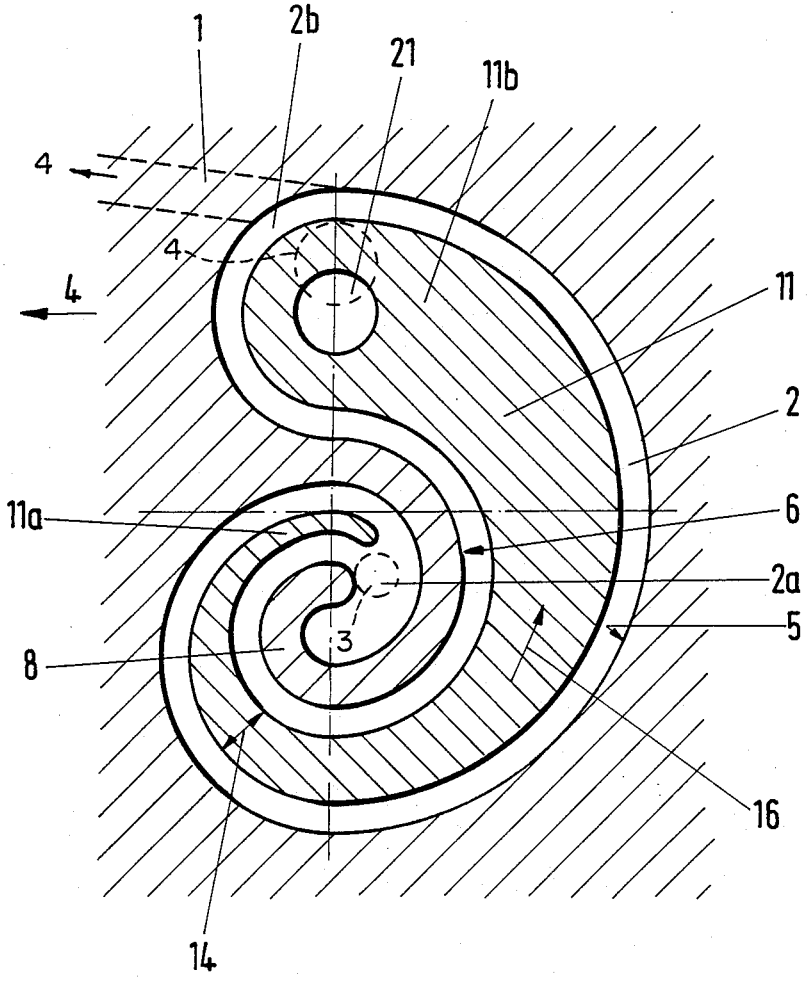
FIG. 2 illustrates a modified embodiment of FIG. 1.

FIGS. *7a*, *7b*, and *7c* illustrate an embodiment according to FIG. 2 provided as a double displacement machine, FIG. *7b* being taken along the line *7b*—*7b* of FIG. *7a*; FIG. *7c* being taken along the line *7c*—*7c* of FIG. *7a*.

Figure 8:
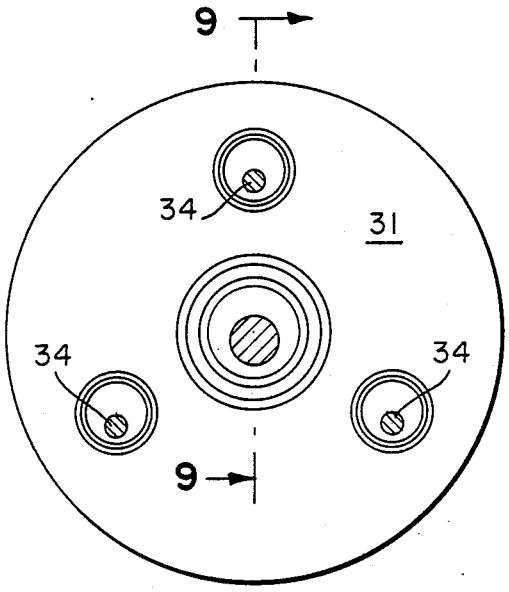
Figure 9:
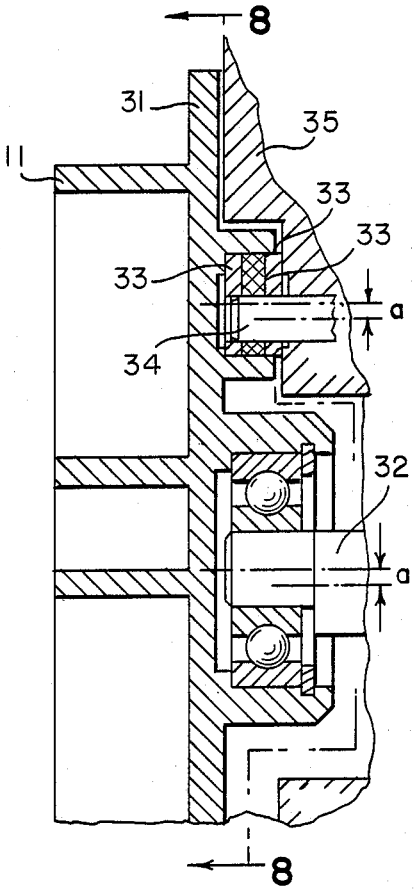

FIG. 8 is a view taken along the line 8—8 of FIG. 9; and

FIG. 9 illustrates a further view of a displacement body of the present invention as viewed along line 9—9 of FIG. 8

DETAILED DESCRIPTION OF THE PREFERRED EMBODIMENTS

The invention is based on the object of improving a displacement machine of the type described with regard to production engineering aspects and its overall efficiency.

This object is achieved according to the invention by the following features:

(a) the looping angle of the displacement body is $<400°$, preferably $<395°$;

(b) the radial width of the displacement body increases continuously from its one end to its other end;

(c) the clear radial width of the displacement chamber increases continuously in the same direction as the displacement body from its one end to its other end;

(d) the displacement body has its eccentric bearing in the region of its greatest radial width;

(e) the said outlet is arranged in the region of the greatest radial width of the displacement body and of the displacement chamber, respectively;

(f) the eccentric drive input or output direction of the displacement body is in the direction of the increase in its radial width.

In a specific embodiment, it may be advantageous if the outer peripheral wall of the displacement chamber consists of a plurality of smoothly adjoining part circles of reduced radius, while the inner peripheral wall of the displacement chamber consists of at least one part circle. In this case it is expedient if the at least one part circle of the inner peripheral wall of the displacement chamber is at least approximately concentric to the third part circle of the outer peripheral wall of the displacement chamber.

In particular, it is advantageous if the mutually assigned outer and inner part circles extend over the same degrees of angle, and if the inner peripheral wall of the displacement chamber is formed by a spiral web of approximately equal web width.

The considerably smaller looping angle, in comparison with the prior art, of the displacement body produces a significant improvement in the overall efficiency of the displacement machine. This reduction in the looping angle also allows the displacement body to be designed with thicker walls. In this case it is particularly advantageous that the eccentric bearing of the displacement body can be provided in the region of its greatest radial width, that is in the most stable part from a mechanical viewpoint.

The displacement machine may be driven by the fluid itself and then operate as a motor or, for example, as a volumeter; however, it can also be motor-driven and then act as a pump or compressor. In comparison with displacement machines having two or more separate displacement chambers (for example in accordance with German Offenlegungsschrift No. 22 30 773), the embodiment according to the invention has lower surging, an advantage which makes itself felt in particular in relatively high power ranges.

The new displacement machine as a smaller overall size in comparison with previously known constructions of the same output capacity. At the same time, it is particularly advantageous for production and stockkeeping that displacement chamber and displacement body can be combined in the manner of segments of disk-shaped material into an assembly of the desired axial thickness. As a result, such displacement machines of different output capacity can be changed by simply changing the number of disk parts to be connected to one another.

It is possible in principle to close the displacement chamber from both sides, seen axially, with smooth covers, between which the displacement body is then mounted freely movable. However, it is also possible that the displacement chamber is provided axially on one side with a wall and receives a displacement body which for its part has axially on one side a wall which has devices for drive input, drive output, for protection against twisting or the like. In fact, with the new displacement machine it is possible to dispense with a protection against twisting provided that the eccentric drive input or output direction of the displacement body is in the direction of the increase in its radial width. However, since the displacement body has, in the new embodiment, a greater accumulation of material at its center or in the region where the highest pressure peaks occur, large-dimensioned bearings can be provided here. In the case of the design described above with a wall axially on one side, a clearance may be taken through the latter, for example centrally, into the displacement body, so as to prevent tilting movements of the displacement body.

In a modified embodiment, the displacement body may have a central wall, seen in the axial direction, on both sides of which the axially extending spiral webs are attached.

For reducing wear, it is advantageous if the walls of the displacement chamber and/or of the displacement body are coated.

Similarly, to reduce friction in the operation of the displacement machine, it may be advantageous if the displacement body is provided on at least one of its two axial faces, in the peripheral region, with an axial rib. This measure may be provided instead of the coating mentioned above or else in addition to it.

The displacement body and/or the walls or webs of the displacement chamber may be of a hollow design. The cavities thus formed may be closed off by covers so as to produce chambers, which can be used with corresponding tube connections for cooling or heating. This applies primarily to the components provided with a wall on one side, the production of which can be produced by cutting or non-cutting methods in the case of metal materials. If plastic materials are used, which are likewise suitable depending on operating conditions, the corresponding injection or compression molding methods may be applied.

As a further characteristic, the new displacement machine also has a dry admission behavior. To bridge production tolerances, resilient eccentric bearing elements may be used advantageously in the bearing region between the input shaft, which is then designed as a simple shaft, and displacement body. Depending on the overall size, the displacement body may be driven at a frequency also in excess of 120 hz.

Figure 1:
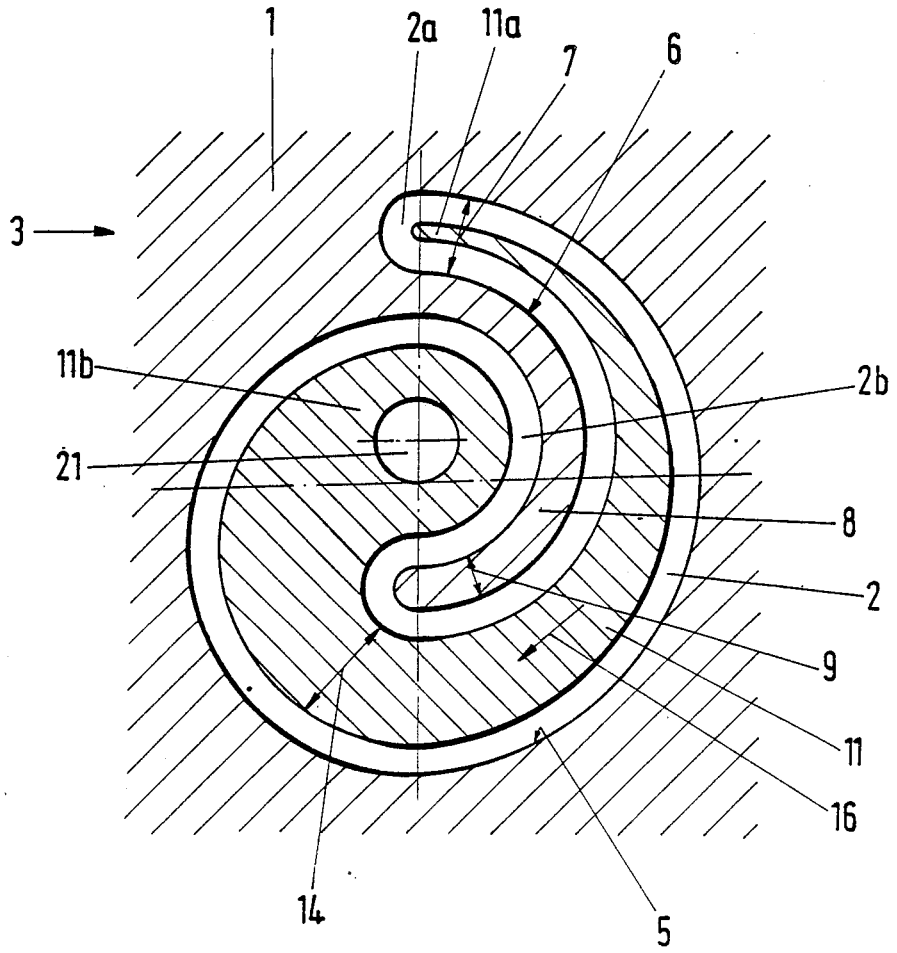
FIG. 1 illustrates, in cross-section, an embodiment of a displacement chamber with a displacement body inserted therein in a non-operating position.

FIG. 1 shows a displacement chamber 2, arranged within a casing 1, running spirally and spanning somewhat more than 360°, which chamber leads from an inlet indicated by an arrow 3 to an outlet, not shown in more detail in this figure. The groovelike displacement chamber 2 is defined by an outer peripheral wall 5 and an inner peripheral wall 6. In this case, the outer peripheral wall 5 consists approximately of three adjoining semicircles of reduced radius, while the inner peripheral wall 6 is formed by only a single semicircle, which is at least approximately concentric to the third semicircle of the outer peripheral wall 5.

In the case of the exemplary embodiment according to FIG. 1, the clear radial width 7 of the displacement chamber 2, that is the respective radial distance between the peripheral walls 5, 6, increases from the radially outer end 2*a* of the displacement chamber 2 to the radially inner end. In this case, the inner peripheral wall 6 of the displacement chamber 2 is formed by a spiral web 8 of approximately equal web width 9.

In the displacement chamber 2 there is inserted a displacement body 11, which is shown away from the walls 5, 6 of the displacement chamber 2 only for reasons of illustration. The outer contour of the displacement body 11 is likewise made up of a plurality of adjoining part circles of reduced radii, the radial width 14 of the displacement body 11 increasing continuously inwards in circumferential direction from its free, radially outer end ll*a*. In this case, there is in the central region ll*b* an accumulation of material, which makes possible for example the arrangement of a large-dimensioned eccentric bearing 21.

FIG. 2 shows a modified embodiment, in which the radial width 14 of the displacement body 11 increases continuously from its radially inner end ll*a* to its radially outer end 11*b*. The displacement chamber 2 follows a corresponding course. The eccentric bearing 21, like the outlet indicated by an arrow 4, is on the outside. The eccentric drive input or output direction 16 of the displacement body 11 is in the direction of the increase in its radial width 14.

Figure 3:
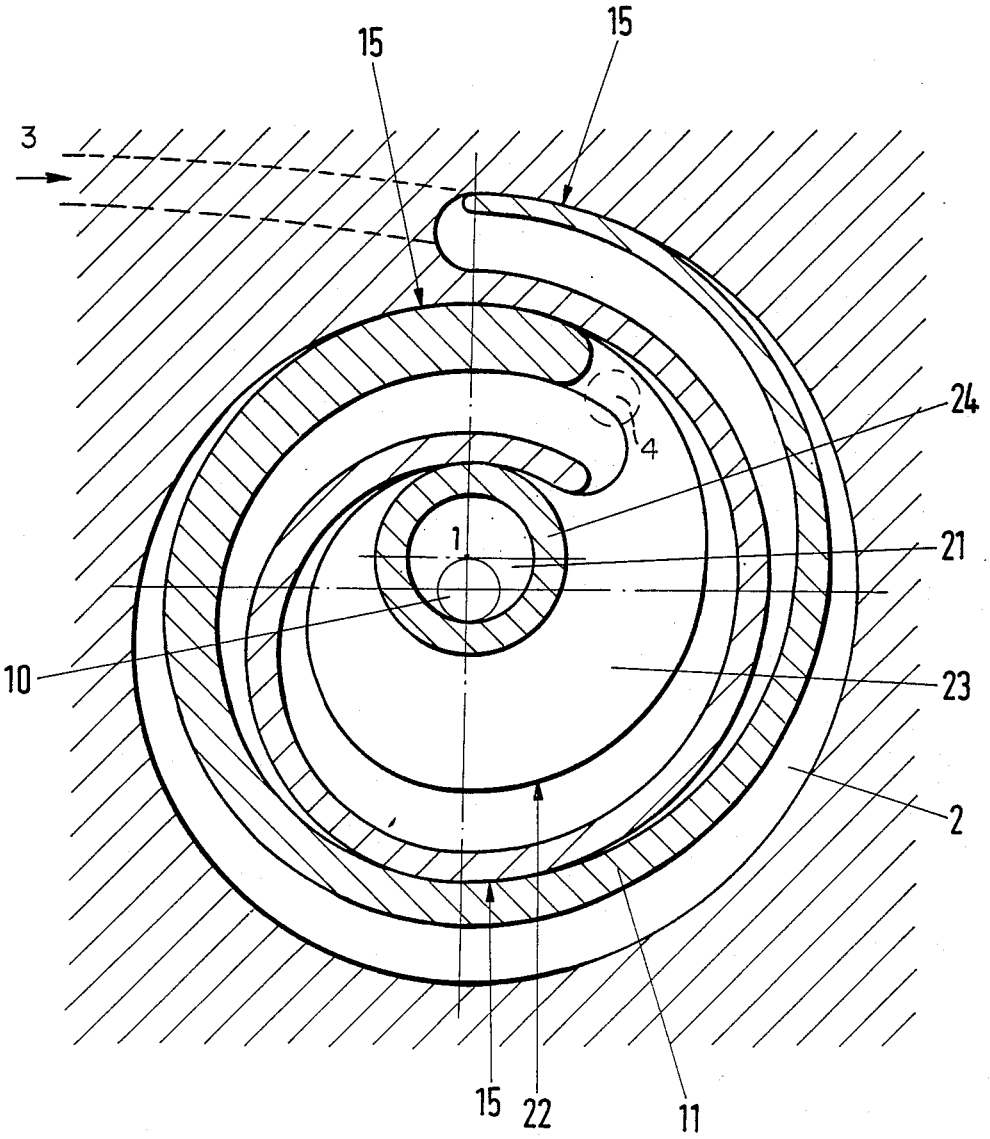
FIG. 3 illustrates a modified embodiment of FIG. 1, illustrating the displacement body in a first working position.
Figure 4:
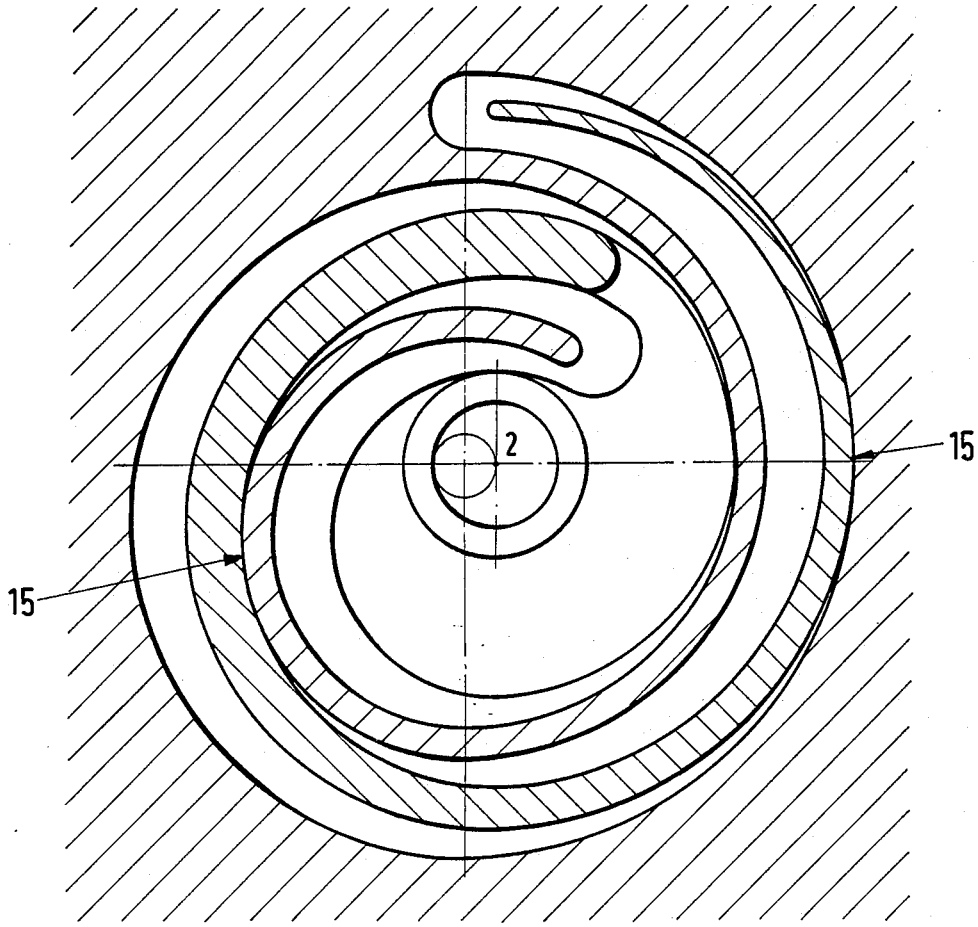
FIGS. 4 to 6 illustrate three different working positions of the displacement body, progressing from the embodiment according to Figure 3.
Figure 5:
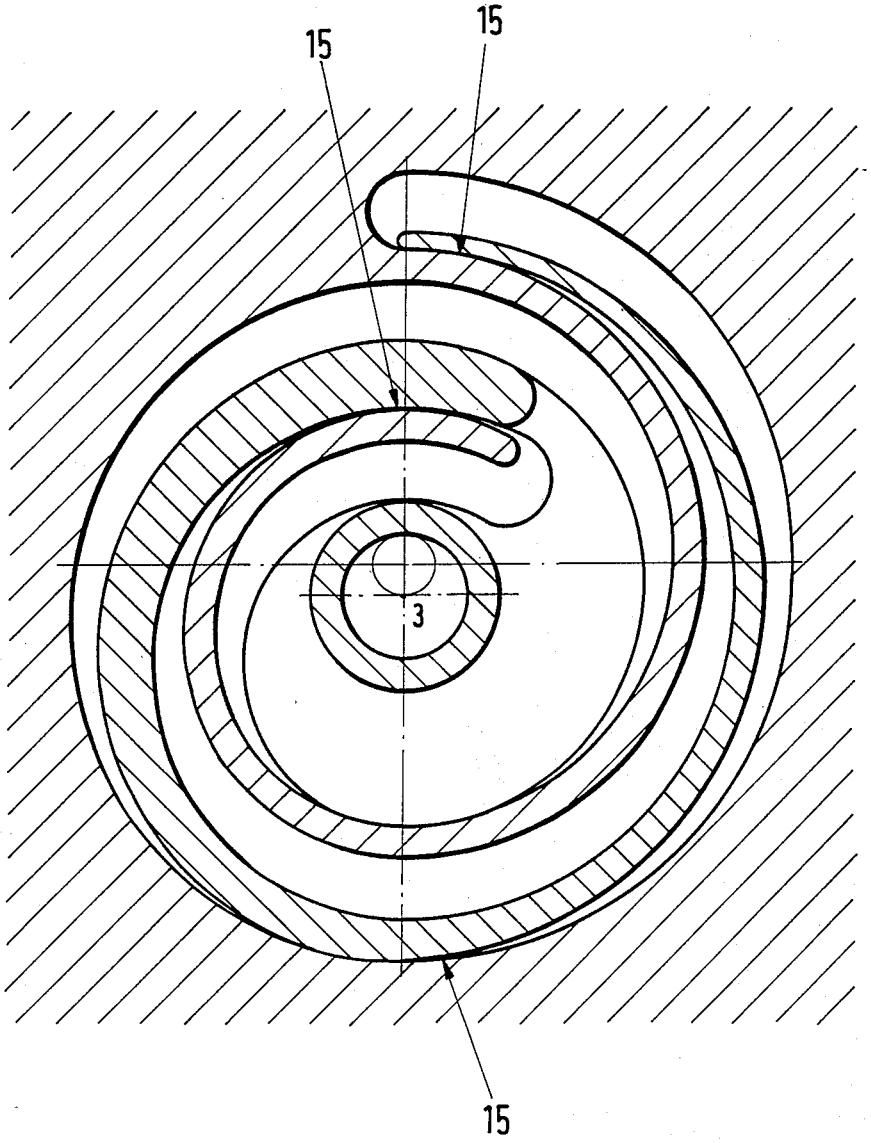
Figure 6:
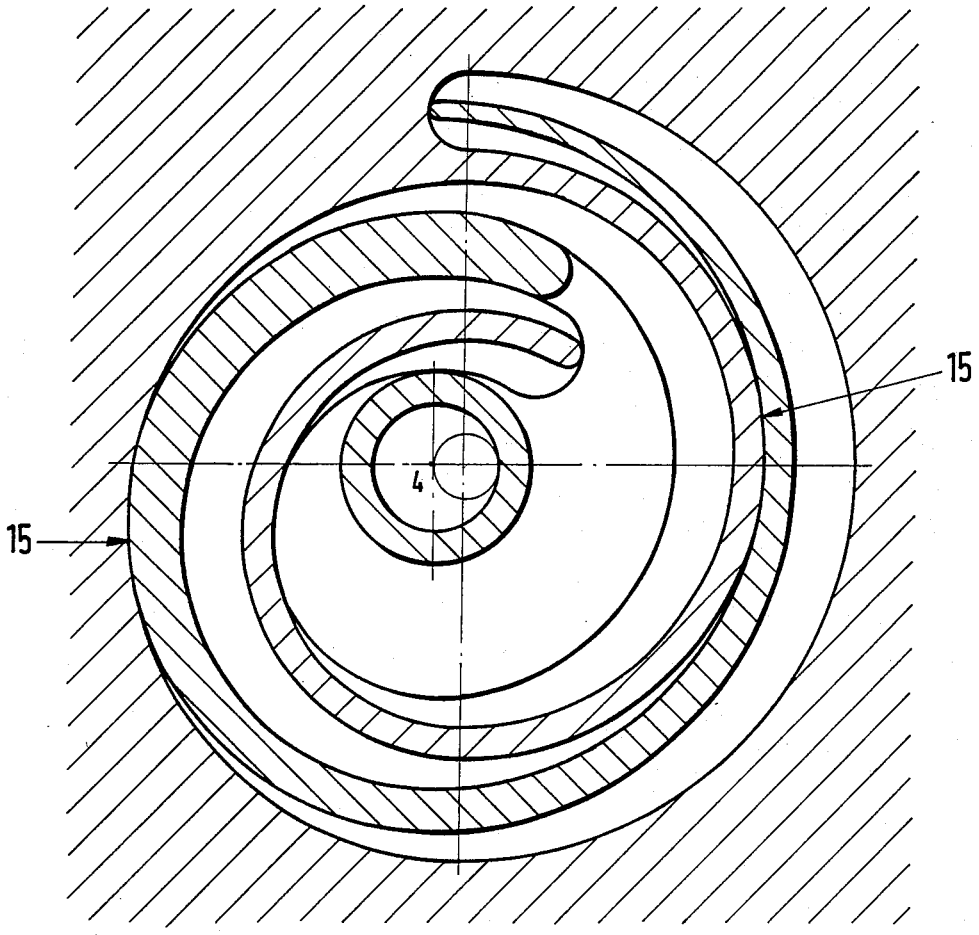

FIG. 3 shows a modified embodiment, the design of which corresponds in principle to that of FIG. 1. However, in FIG. 3 the displacement body 11 is shown in a first working position, in which it rests against the walls 5, 6 of the displacement chamber 2. In this case, the displacement body 11 can be eccentrically driven in such a way that each of its points executes a circular movement limited by the peripheral walls 5, 6 of the displacement chamber 2, the radii of curvature of the displacement body 11 and the said peripheral walls in the displacement chamber being dimensioned such that, during its circulating, twist-free movement, the displacement body at least virtually touches the inner and outer peripheral walls 6, 5 at a continuously progressing sealing line 15. This sequence of movements is shown with reference to four working positions in FIGS. 3 to 6. The reference numeral 10 denotes the eccentricity. The drawn-in contour 22 denotes the outer contour 22 of a plate-shaped elevation 23 or the like, which is seated on a closure cover, not shown in more detail, at one end of the displacement body 11 and bears a bush 24 for the eccentric bearing 21 of the displacement body 11.

FIGS. 3 to 6 show the progression of the sealing lines 15 for the respective drawn-in positions 1 to 4.

Figure 7A:
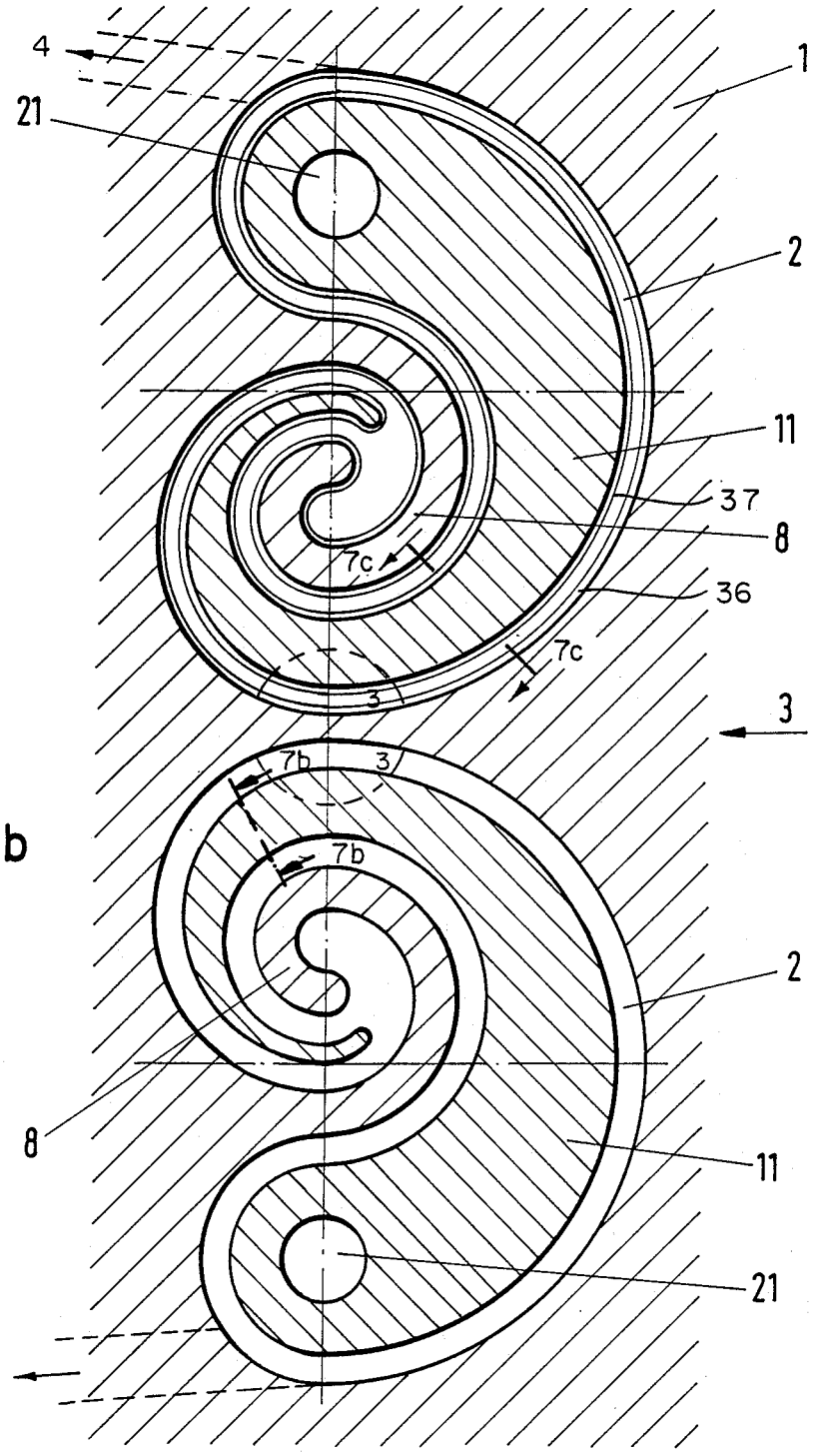

FIG. 7*a* shows a double displacement machine which comprises two single machines according to FIG. 2, arranged mirror-symmetrically to each other. Here there are two outer eccentric bearings 21, the input or output shafts of which may be connected by a toothed belt or the like for synchronization. The arrow 3 shows a common inlet for both drive units, while the arrows 4 indicate the respective outlet. If this machine is driven by the medium axially at the center, it operates as a motor; the shafts are then output shafts. If, on the other hand, the machine is motor-driven, the medium is taken in axially at the center and the machine then runs as a pump or as a compressor. The drive input or output of this double-shaft machine is effected by one shaft, since the second shaft runs synchronously due to the said toothed belt and operates as a protection against twisting for the eccentrics.

An additional central shaft may also be provided, which couples the two outer shafts for example by an externally toothed gear wheel which engages in gear wheels of the said shafts. As a result, internal step-up or step-down ratios between the central shaft and the two eccentric shafts may be chosen within certain relative sizes of such machines, or alternatively the central shaft encloses the smaller externally toothed gear wheels of the outer shafts by a pot-shaped, internally toothed body (comparable to a planetary gear). The walls of the displacement chamber and of the displacement means are coated with coatings 36 and 37.

Figure 7B:
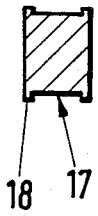
Figure 7C:
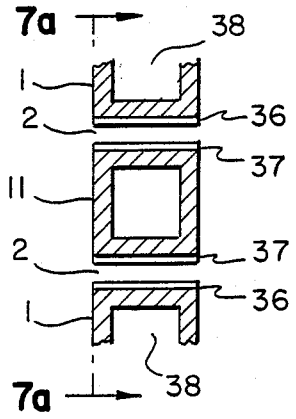

FIG. 7*b* shows the cross-section of the displacement body 11 and reveals that the latter is provided on its two axial faces 17, in the peripheral region, with an axial rib 18, in order to reduce the friction within the displacement chamber 2. FIG. 7*c* is a cross-section of the displacement body 11 and displacement chamber 2 showing a hollow displacement body and a displacement chamber with hollow walls.

In FIGS. 8 and 9, displacement body 11 includes a wall 31 having means for a drive input such as shaft 32 as well as protection against twisting comprising a bearing 33 and a pin 34 disposed in a housing 35.

It is favorable for all embodiments if the ratio of the narrowest radial width 14 of the displacement body 11 to its widest radial width is within the range 1:3 to 1:12.

In the case of an outer inlet or outlet, a tangential arrangement may be chosen, but it is not absolutely necessary.

It is expedient to design the displacement chamber 2 somewhat longer than is necessary for receiving the displacement body 11. This has the effect of suppressing surging and of providing space for the inlet or outlet 3, 4.

What is claimed is:

1. A displacement machine for fluids, comprising:

a casing member having a displacement chamber therein, said chamber being a groove having inner and outer peripheral walls and extending from an inlet to an outlet, said groove being a spiral exceeding 360°;

displacement means provided with inner and outer peripheral walls corresponding to said chamber walls, said displacement means being eccentrically mounted in said chamber for circulating, twist-free movement therein in such a manner that said corresponding walls touch in a continuously progressing sealing line;

said displacement means having a looping angle of less than about 400°;

said chamber and said displacement means, respectively having correspondingly increasing radial widths from a first to a second end thereof;

said displacement means being eccentrically mounted adjacent the second end thereof;

said outlet being positioned adjacent said second end; and said displacement means provided to be driven in a direction corresponding to the increase in said radial width.

2. The displacement machine of claim 1, wherein the outer peripheral wall of the displacement chamber includes a plurality of smoothly adjoining part circles of reduced radius, and the inner peripheral wall of the displacement chamber includes at least one part circle.

3. The displacement machine of claim 2, wherein the at least one part circle of the inner peripheral wall of the displacement chamber is at least approximately concentric to one of the part circles of the outer peripheral wall of the displacement chamber.

4. The displacement machine of claim 2, wherein mutually corresponding part circles of said inner and outer walls extend over the same degrees of angle.

5. The displacement machine of claim 1, wherein the inner peripheral wall of the displacement chamber is formed by a spiral web of approximately equal web width.

6. The displacement machine of claim 1, wherein the displacement means is provided axially on one side with a wall including means for drive input or drive output and for protection against twisting.

7. The displacement machine of claim 1, wherein the walls of either of the displacement chamber and of the displacement means are coated.

8. The displacement machine of claim 1, wherein the displacement means is provided on at least one of its peripheral walls with an axial rib.

9. The displacement machine of claim 1, wherein the displacement means and the walls of the displacement chamber are hollow.

10. The displacement machine of claim wherein the looping angle is less than about 395°.

* * * * *